US005092805A

United States Patent [19]

Shon

[11] Patent Number: 5,092,805

[45] Date of Patent: Mar. 3, 1992

[54] MANUFACTURING METHOD FOR DISPENSER CODE

[75] Inventor: Kyung-cheon Shon, Suwon, Rep. of Korea

[73] Assignee: Samsung Electron Devices Co., Ltd., Rep. of Korea

[21] Appl. No.: 645,327

[22] Filed: Jan. 24, 1991

Related U.S. Application Data

[63] Continuation-in-part of Ser. No. 438,611, Nov. 17, 1989, abandoned.

[30] Foreign Application Priority Data

Nov. 11, 1988 [KR] Rep. of Korea ..... 88-15259[U]

[51] Int. Cl.[5] ..... H01J 9/04

[52] U.S. Cl. ..... 455/50; 313/346 DC

[58] Field of Search ..... 445/50, 51; 313/346 R, 313/346 DC

[56] References Cited

U.S. PATENT DOCUMENTS 2,844,494 7/1958 Rexer ..... 427/77

3,458,749 7/1969 Van Stratum et al. ..... 313/346 R 4,007,393 2/1977 Van Stratum et al. ..... 313/346 R

*Primary Examiner*—Kenneth J. Ramsey

*Attorney, Agent, or Firm*—Morgan & Finnegan

[57] ABSTRACT

A method for manufacturing a dispenser cathode is disclosed. The method includes a step of immersing, in an aqueous solution containing an aluminum compound, either (1) a powder mixture made by mixing metal powder selected from among Mo, Ta, W or alloys thereof with a carbonate selected form the group of Sr, Ba, Ca, or mixtures thereof or (2) a pellet of such a metal powder mixture formed into a desired shape, such that the aluminum ingredient in the aqueous solution can be impregnated into (1) the powder mixture or (2) the pellet. According to the present method, heat treatment at a temperature of over 1700° C. is not required, unlike conventional methods where such high heat treatment is required. Therefore the decrease of electron releasing efficiency due to adverse reactions generated by the high temperature heat treatment of the prior art can be avoided.

12 Claims, 1 Drawing Sheet

MANUFACTURING METHOD FOR DISPENSER CODE

This is a continuation-in-part of co-pending application Ser. No. 07/438,611, filed on Nov. 17, 1989, now abandoned.

FIELD OF THE INVENTION

The present invention relates to a method for manufacturing a dispenser cathode. More particularly, the invention relates to a method for manufacturing a dispenser cathode in which the decrease of the electron releasing efficiency due to high temperature heat treatment can be restrained.

BACKGROUND OF THE INVENTION

A general-type of dispenser cathode, such as the type shown in FIG. 1, comprises a porous pellet 3 containing barium-calcium aluminate as the cathode material, a cup 2 for storing the pellet 3, and a sleeve 1 for storing a heater 4.

Among these components, the pellet 3, which is an important component, is manufactured by sintering a high melting point metal powder such as tungsten (W). The pellet 3 has to undergo a high temperature heat treatment because the material itself is a high melting point heat resistant metal.

There are many different methods for manufacturing the pellet. One such method is carried out in such a manner that a mixture of $BaCO_3$, $CaCO_3$, and $Al_2CO_3$ as the cathode material, or a barium-calcium aluminate obtained by baking such a mixture, is impregnated into a porous pellet made of a heat resistant metal such as tungsten. Another method is carried out such that a mixture prepared by mixing a heat resistant metal powder such as tungsten, molybdenum, or tantalum with a cathode material in a proper ratio is fabricated through compression into a required shape, followed by sintering. (See, for example, U.S. Pat. Nos. 4,737,679 and 4,400,648.)

In such conventional methods, a baking process has to be carried out at a temperature of over 1700° C. However, according to these methods, the electron releasing efficiency is greatly lowered due to the adverse reaction generated by the high temperature treatment. The reason is that $Al_2O_3$ (e.g. alumina), which is used as a cathode material, has a very high melting point and its reaction temperature is related to other cathode materials. As long as $Al_2O_3$ is used as the cathode material in conventional processes, the high temperature baking process causing the adverse thermal effects cannot be excluded.

SUMMARY OF THE INVENTION

Therefore, it is an object of the present invention to provide a manufacturing method for a dispenser cathode in which the decrease of the electron releasing efficiency in the cathode material accruable due to a high temperature heat treatment can be restrained.

To accomplish this and other objects of the invention, a method for manufacturing a dispenser cathode according to the present invention includes a step of immersing, in an aqueous solution containing an aluminum compound, a powder mixture made by mixing metal powder selected from among Mo, Ta and W or alloys thereof with a carbonate selected from the group of Sr, Ba, Ca or a mixture thereof, or immersing in such a solution a pellet of the former metal powder mixture formed into a desired shape, such that the aluminum ingredient in the aqueous solution will be impregnated into the powder mixture or the pellet. Typical aluminum compounds include aluminum nitrate, aluminum oxide and aluminum hydroxide. Preferably, the aluminum compound is aluminum nitrate and the aqueous solution includes water and the aluminum compound.

BRIEF DESCRIPTION OF THE DRAWINGS

The above objects and other advantages of the present invention will become more apparent by describing the preferred embodiments of the present invention with reference to the examples which follow and to the attached drawing, in which.

DESCRIPTION OF THE PREFERRED EMBODIMENTS

Figure 1:
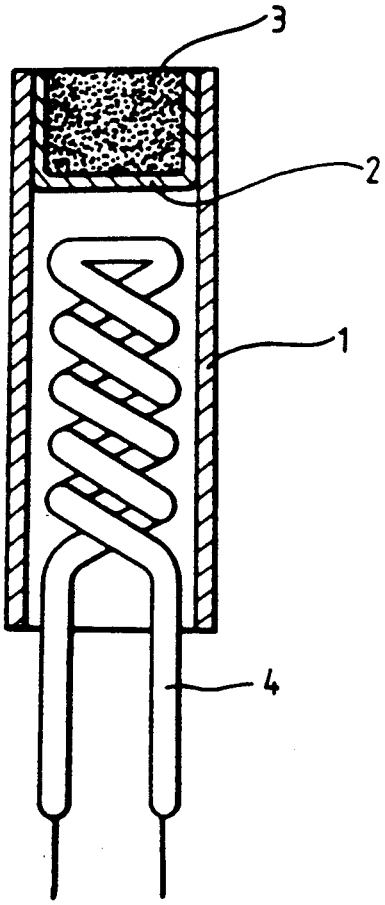
FIG. 1 is a sectional view of a dispenser cathode.

The invention will now be described in greater detail by way of reference to the following examples.

EXAMPLE 1

$NaCO_3$ is dissolved in a solution containing a mixture or $SrNO_3$, $BaNO_3$ and $CaNO_3$ such that Sr, Ba and Ca are commonly deposited in the form of carbonates. Then, the deposited carbonates are recovered, dried and mixed with metal powders of Mo, Ta, W or alloys thereof. The resultant mixture is then press-formed into a pellet having a desired shape. Meanwhile, an aluminum compound is dissolved in a aqueous solution. The pellet is then immersed in the solution to conduct a impregnation. Thereafter, the pellet is baked at a temperature of 1200°-1300° to remove $CO_2$, thereby completing the manufacturing of the pellet.

EXAMPLE 2

$NaCO_3$ is dissolved in a solution containing $SrNO_3$, $BaNO_3$ and $CaNO_3$ so that Sr, Ba and Ca are commonly deposited in the form of carbonates through chemical reactions. Then the deposited carbonates are recovered and dried. The dried carbonates are then mixed with metal powders of Mo, Ta, W or alloys thereof. The mixture is then press-formed into a pellet having a desired shape. Thereafter, the pellet is baked at a temperature of 1200°-1300° C. to remove $CO_2$. The pellet is then immersed into an aqueous solution containing a dissolved aluminum compound to conduct an impregnation, and the pellet is taken out and dried. Next, the pellet is subjected to a reduction treatment in a hydrogen atmosphere at a temperature of slightly over 1200°-1300° C. in order to remove the residue oxygen atoms.

EXAMPLE 3

$NaNO_3$ is dissolved in a solution containing $SrNO_3$, $BaNO_3$ and $CaNO_3$ so that Sr, Ba and Ca are commonly deposited in the form of carbonates through chemical reactions. Then, the deposited carbonates are recovered and dried, and the dried carbonates are mixed with metal powders of Mo, Ta, or W alloys thereof. The resultant mixture is then put into an aqueous solution containing an aluminum compound in order to impregnate the mixture. The impregnated mixture is then recovered and dried. The dried mixture is then formed into a pellet having a desired shape. The fabricated pellet is then subjected to baking and reducing processes, thereby completing the manufacturing of the pellet.

Referring again to FIG. 1, a pellet 3, manufactured based on the above-described processes of Examples 1, 2 or 3, is inserted into a cup 2 secured at the leading end of a sleeve 1. The pellet 3 may be fixed by resistance welding or laser welding.

According to the manufacturing method of the present invention as illustratively described above in Examples 1, 2 and 3, a heat treatment at a temperature of over 1700° C. is not required, unlike conventional methods. Rather, all the required baking and reducing processes can be conducted at a temperature of no more than about 1200°-1300° C. Accordingly, a decrease of electron releasing efficiency due to adverse reactions generated at the high temperature heat treatment of the prior art can be avoided. The electron releasing efficiency can thereby be improved, making it possible to produce a high performance cathode.

Although the invention has been described in detail above by way of reference to the preferred embodiments and certain examples, it should be understood that the invention is not limited to the disclosed embodiments but should only be interpreted by way of reference to the claims which follow.

What is claimed is:

1. A method of manufacturing a dispenser cathode, comprising the steps of:

(a) immersing, in an aqueous solution containing an aluminum compound, either (1) a powder mixture made by mixing metal powder selected from among Mo, Ta, W or alloys thereof with a carbonate selected from the group os Sr, Ba, Ca or a mixture thereof; or (2) a formed pellet comprising the metal powder mixture of (1); and (b) causing an aluminum ingredient in said aqueous solution to be impregnated into either (1) said powder mixture or (2) said pellet.

2. A method of manufacturing a dispenser cathode, comprising the steps of:

(a) mixing powder metal selected from the group of Mo, Ta, W or alloys thereof with a carbonate selected from the group of Sr, Ba, Ca or a mixture thereof;

(b) forming said powder mixture of step (a) into a shape; and (c) impregnating said resultant shaped powder mixture with an aluminum ingredient by dispersing said shaped powder mixture in an aqueous solution containing an aluminum compound.

3. A method of manufacturing a dispenser cathode, as recited in claim 2, further comprising the steps of:

(d) removing the impregnated shaped mixture from the solution; and (e) heating the formed shape at a temperature of about 1200°-1300° C. to remove $CO_2$.

4. A method of manufacturing a dispenser cathode, comprising the steps of:

(a) mixing powder metal selected from the group of Mo, Ta, W or alloys thereof with a carbonate selected from the group of Sr, Ba, Ca or a mixture thereof;

(b) forming the mixture from step (a) into a shape;

(c) heating said shaped mixture to a temperature of between about 1200° to 1300° C. to remove $CO_2$; and (d) impregnating said shaped and heated mixture with an aluminum ingredient by dispersing said shaped powder mixture in an aqueous solution containing an aluminum compound.

5. A method of manufacturing a dispenser cathode, as recited in claim 4, further comprising the step of:

(e) heating said impregnated shape in a hydrogen reducing atmosphere to substantially remove residue oxygen atoms.

6. A method of manufacturing a dispenser cathode, as recited in claim 5, wherein said aluminum compound is aluminum nitrate.

7. A method of manufacturing a dispenser cathode, comprising the steps of:

(a) mixing powder metal selected from the group of Mo, Ta, W or alloys thereof with a carbonate selected from the groups of Sr, Ba, Ca or a mixture thereof; and (b) impregnating said resultant mixture with an aluminum ingredient by dispersing said powder mixture in an aqueous solution containing an aluminum compound.

8. A method of manufacturing a dispenser cathode, as recited in claim 7, further comprising the steps of (c) removing the impregnated mixture from the solution;

(d) forming the impregnated powder into a shape; and (e) heating the formed shape.

9. A method of manufacturing a dispenser cathode, as recited in claim 7, wherein said aluminum compound is aluminum nitrate.

10. A method of manufacturing a dispenser cathode, as recited in claim 1, wherein said aluminum compound is aluminum nitrate.

11. A method of manufacturing a dispenser cathode, as recited in claim 2, wherein said aluminum compound is aluminum nitrate.

12. A method of manufacturing a dispenser cathode, as recited in claim 4, wherein said aluminum compound is aluminum nitrate.

* * * * *